US009884418B2

(12) United States Patent
Yu

(10) Patent No.: US 9,884,418 B2
(45) Date of Patent: Feb. 6, 2018

(54) DISASSEMBLY TOOL KIT FOR REPLACING VEHICULAR DECORATIVE PLATES

(71) Applicant: Chia-Feng Yu, Taichung (TW)

(72) Inventor: Chia-Feng Yu, Taichung (TW)

( * ) Notice: Subject to any disclaimer, the term of this patent is extended or adjusted under 35 U.S.C. 154(b) by 101 days.

(21) Appl. No.: 14/988,230

(22) Filed: Jan. 5, 2016

(65) Prior Publication Data

US 2017/0190042 A1 Jul. 6, 2017

(51) Int. Cl.
*B25G 3/18* (2006.01)
*B66F 15/00* (2006.01)

(52) U.S. Cl.
CPC ..... *B25G 3/18* (2013.01); *B66F 15/00* (2013.01)

(58) Field of Classification Search
CPC ..... B25G 3/18; B66F 15/00
USPC ..... 81/489
See application file for complete search history.

(56) References Cited

U.S. PATENT DOCUMENTS 5,331,869 A * 7/1994 Webb ..... B25F 1/02 16/427
5,415,064 A * 5/1995 Chang ..... B25B 13/12 81/166
5,829,082 A * 11/1998 Moreira ..... B25F 1/02 7/167
6,079,075 A * 6/2000 Velez-Juan ..... A46B 7/04 15/143.1
6,546,585 B1 * 4/2003 Blaustein ..... A46B 5/026 132/321
7,386,913 B2 * 6/2008 Jackson ..... A46B 7/04 15/145
9,259,834 B2 * 2/2016 Mouch ..... B25G 1/04

* cited by examiner

*Primary Examiner* — Hadi Shakeri
(74) *Attorney, Agent, or Firm* — Muncy, Geissler, Olds & Lowe, P.C.

(57) ABSTRACT

A disassembly tool kit for replacing vehicular decorative plates comprises a handle including a handheld end and a handle-side engagement end far away from the handheld end, and at least one replaceable tool each including a tool-side engagement end corresponding to the handle-side engagement end and a working end far away from the tool-side engagement end. The handle-side engagement end includes a first fixing element and a first locking element. The working end includes a decorative-plate disassembly element. The tool-side engagement end includes a second fixing element corresponding to the first fixing element for a press-fit engagement and a second locking element corresponding to the first locking element for a locking effect. The user may select an appropriate replaceable tool according to the decorative plate or strip, which is to be disassembled, and install the replaceable tool in the handle.

3 Claims, 6 Drawing Sheets

DISASSEMBLY TOOL KIT FOR REPLACING VEHICULAR DECORATIVE PLATES

FIELD OF THE INVENTION

The present invention relates to a tool for disassembling vehicular decorative plates or strips, particularly to a disassembly tool kit unlikely to harm the edges or surfaces of vehicular decorative plates or strips.

BACKGROUND OF THE INVENTION

For smooth and integral surface and convenient maintenance, a decorative plate or strip is normally assembled to a vehicle in a press-fit way screwlessly. Thereby, the decorative plate or strip can be directly mounted on a lamp holder, a front bumper, a rear bumper, an exterior or interior surface of a front or rear door. Via the press-fit engagement, a decorative plate or strip can be perfectly secured to a vehicle and is hard to drop off. While disassembling a decorative plate or strip, the maintenance worker uses a flat screwdriver, which resembles a thin plate, to dig up the decorative plate or strip.

In traditional operation of replacing a decorative plate or strip, the maintenance worker inserts the tip of a flat screwdriver into the gap between the vehicular surface and the decorative plate or strip and then applies force to gradually dig out the decorative plate or strip. If the flat screwdriver is made of metallic material, it almost inevitably harms the baking varnish or wooden plate of the vehicle. In order to avoid harming the surface of a vehicle, the industry has gradually adopted the disassembly tools made of hard plastic material.

While the maintenance worker disassembles decorative plates or strips mounted on different regions of a vehicle, the spaces of the different regions will apply different constraints to the operation of digging out the decorative plates or strips. Therefore, the maintenance worker needs different types (shapes) of disassembly tools to dig up the decorative plates or strips on different regions. However, multiple disassembly tools cost more money and occupy more space, inconvenient to collect and hard to carry about.

SUMMARY OF THE INVENTION

The primary objective of the present invention is to provide a disassembly tool kit where different disassembly tools can be installed selectively to disassemble decorative plates or strips on different regions.

The present invention proposes a disassembly tool kit for replacing vehicular decorative plates or strips, which comprises a handle and at least one replaceable tool. The handle includes a handheld end and a handle-side engagement end far away from the handheld end. The handle-side engagement end includes a first fixing element and a first locking element. The replaceable tool includes a tool-side engagement end corresponding to the handle-side engagement end and a working end far away from the tool-side engagement end. The working end includes a decorative-plate disassembly element. The tool-side engagement end includes a second fixing element corresponding to the first fixing element and a second locking element corresponding to the first locking element. The first locking element is firmly engaged with the second locking element.

Via the firm press-fit engagement of the first and second fixing elements and the locking effect of the first and second locking elements, the replaceable tool can be installed in the handle. The user may select an appropriate replaceable tool according to the decorative plate or strip, which is to be disassembled, and install the replaceable tool in the handle to satisfy requirement of usage.

DETAILED DESCRIPTION OF THE PREFERRED EMBODIMENTS

The technical contents of the present invention will be described in cooperation with drawings below.

Figure 1:
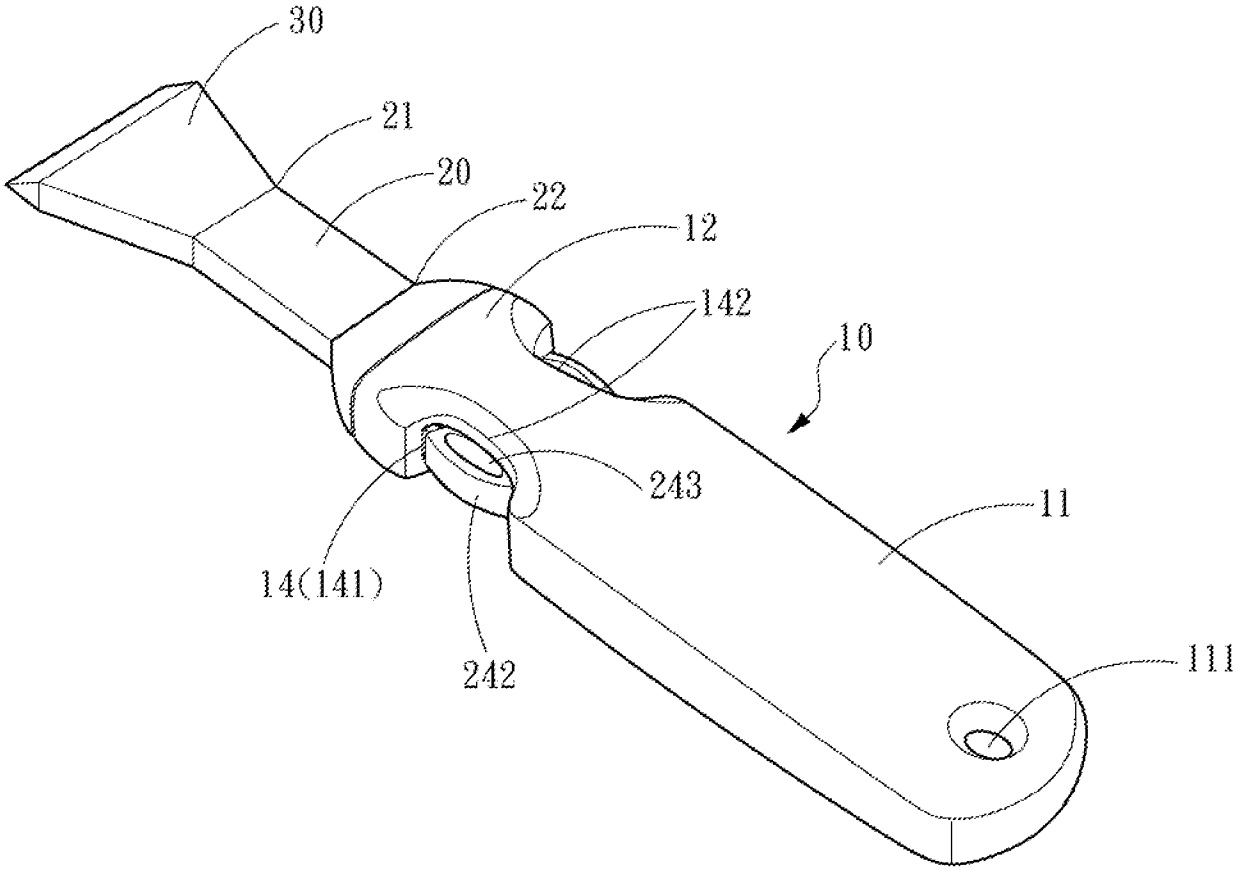
FIG. 1 is a perspective view schematically showing a disassembly tool kit for vehicular decorative plates or strips according to one embodiment of the present invention.
Figure 2:
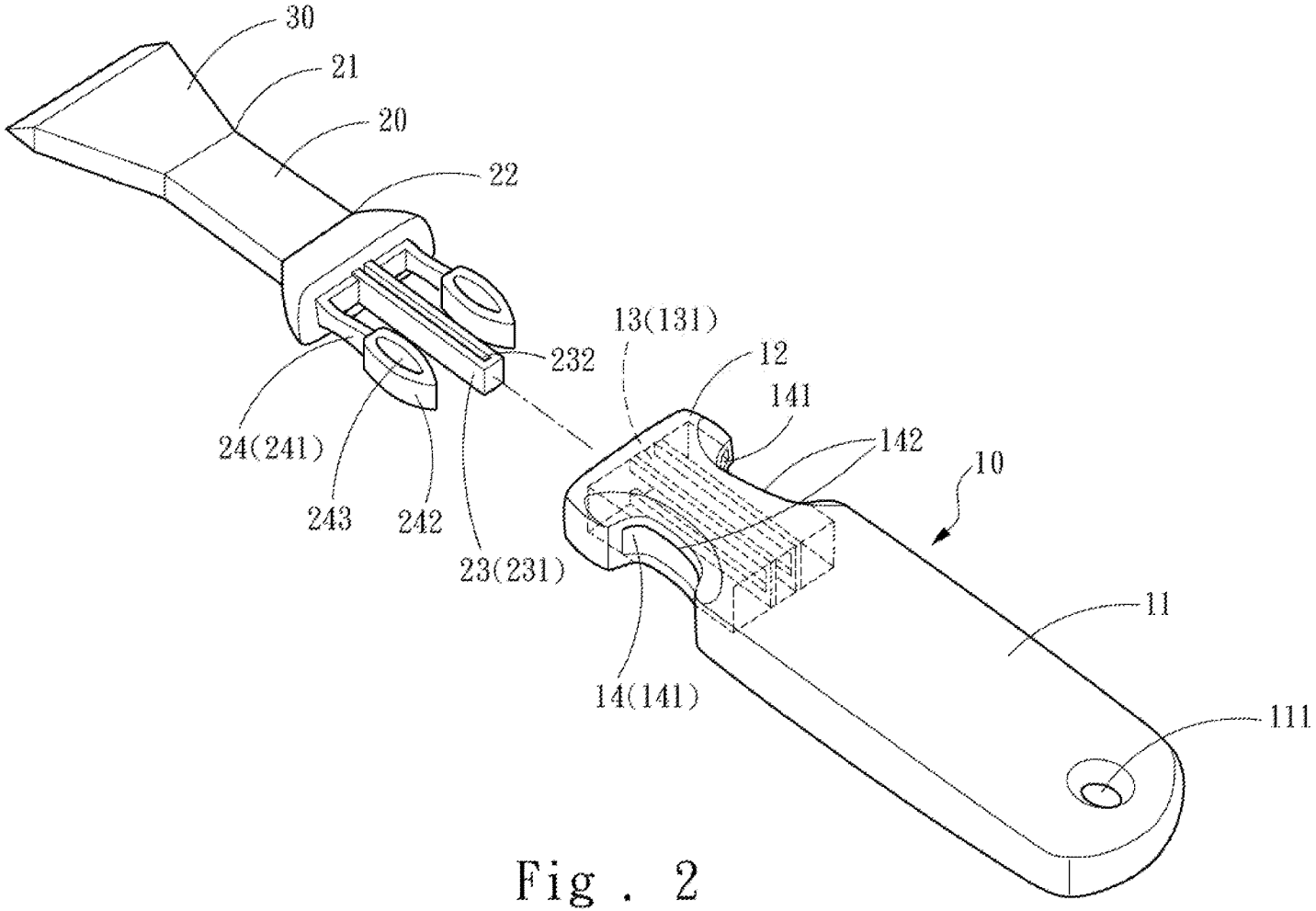
FIG. 2 is an exploded view schematically showing a disassembly tool kit for vehicular decorative plates or strips according to one embodiment of the present invention.
Figure 3:
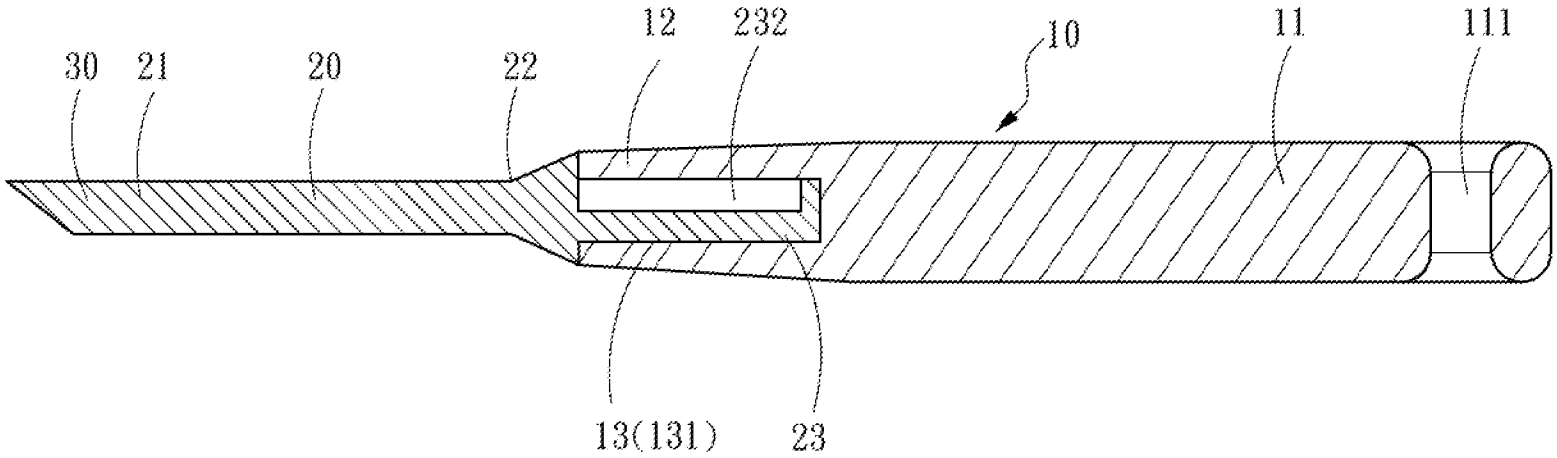
FIG. 3 is a sectional view schematically showing a disassembly tool kit for vehicular decorative plates or strips according to one embodiment of the present invention.

Refer to FIGS. 1-3. The disassembly tool kit for replacing vehicular decorative plates of the present invention comprises a handle 10 and at least one replaceable tool 20. The handle 10 includes a handheld end 11 and a handle-side engagement end 12 far away from the handheld end 11. The handle-side engagement end 12 includes a first fixing element 13 and a first locking element 14. The replaceable tool 20 includes a tool-side engagement end 22 corresponding to the handle-side engagement end 12 and a working end 21 far away from the tool-side engagement end 22. The working end 21 includes a decorative-plate disassembly element 30. The tool-side engagement end 22 includes a second fixing element 23 corresponding to the first fixing element 13 and a second locking element 24 corresponding to the first locking element 14. The second fixing element 23 is firmly engaged with first fixing element 13.

In one embodiment, the first fixing element 13 is a positioning hole 131; the second fixing element 23 is a positioning pillar 231 corresponding to the positioning hole 131. In order to reduce weight and save material, a recess 232 is formed in the inner area of the positioning pillar 231. The positioning pillar 231 is firmly inserted into the positioning hole 131. Via the firm engagement of the positioning pillar 231 and the positioning hole 131, the replaceable tool 20 assembled to the handle 10 would not shake.

The locking effect of the first locking element 14 and the second locking element 24 can prevent the replaceable tool 20 from loosening after the replaceable tool 20 has been assembled to the handle 10. In one embodiment, the second locking element 24 includes two elastic press-fit bars 241 respectively disposed at two sides; the first locking element 14 includes two press-fit slots 141 corresponding to the elastic press-fit bars 241; the elastic press-fit bars 241 are press-fitted into the press-fit slots 141 to achieve a locking effect. The two press-fit slots 141 further include two arc notches 142 respectively formed on two sides of the handle 10. Through the arc notches 142, the user may press the two elastic press-fit bars 241 to unlock the press-fit engagement of the two elastic press-fit bars 241 and the two press-fit slots 141. Therefore, the user can easily disengage the replaceable tool 20 from the handle 10.

In order to let the user press the two elastic press-fit bars 241 comfortably, the two elastic press-fit bars 241 respectively include two elliptic fasteners 242 protruding from the arc notches 142. The elliptic fasteners 242 can prevent the fingers of the user from being scratched and reduce the discomfort in using them. Each of the two elliptic fasteners 242 includes a central opening 243 to reduce weight and increase flexibility.

In order to provide a hanging-up function, a through-hole 111 is formed in the handheld end 11. The edges of the handheld end 11 are chamfered into round corners to increase comfort in usage.

Figure 4:
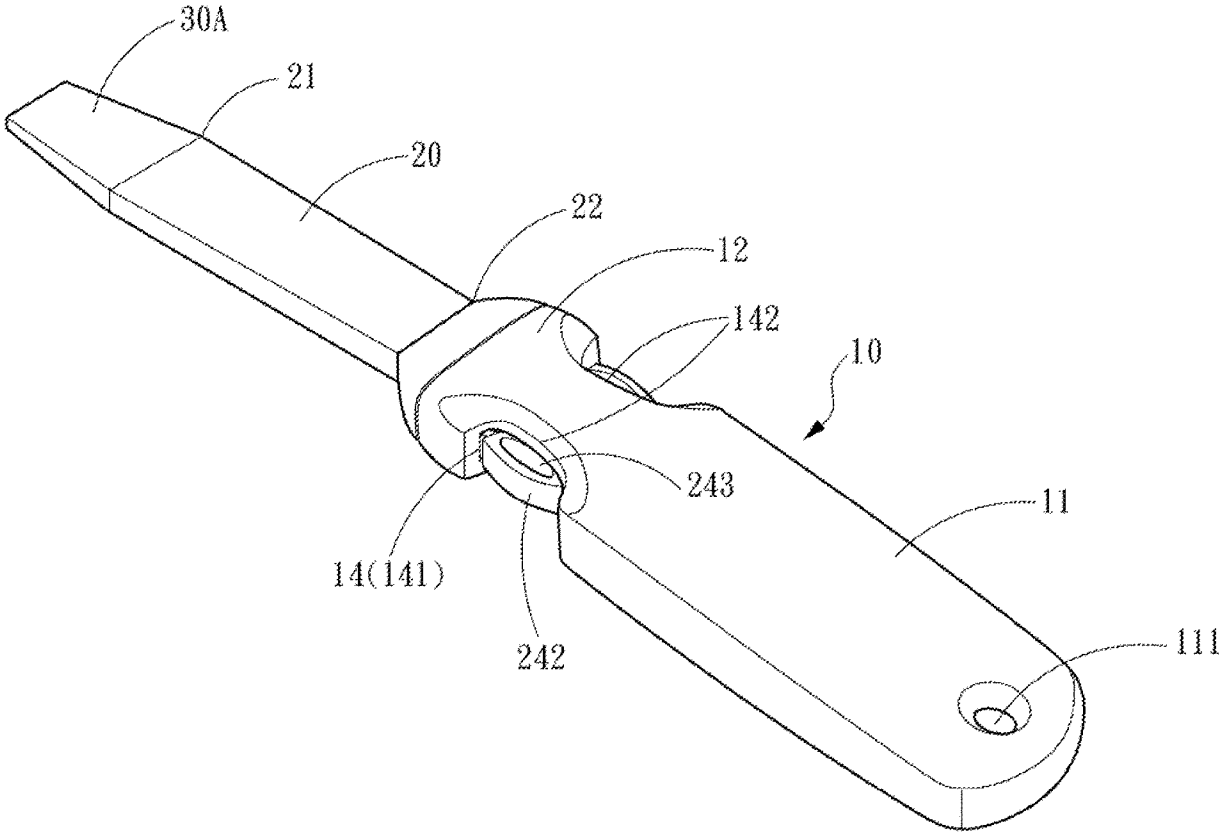
FIG. 4 is a perspective view schematically showing a disassembly tool kit for vehicular decorative plates or strips according to another embodiment of the present invention.
Figure 5:
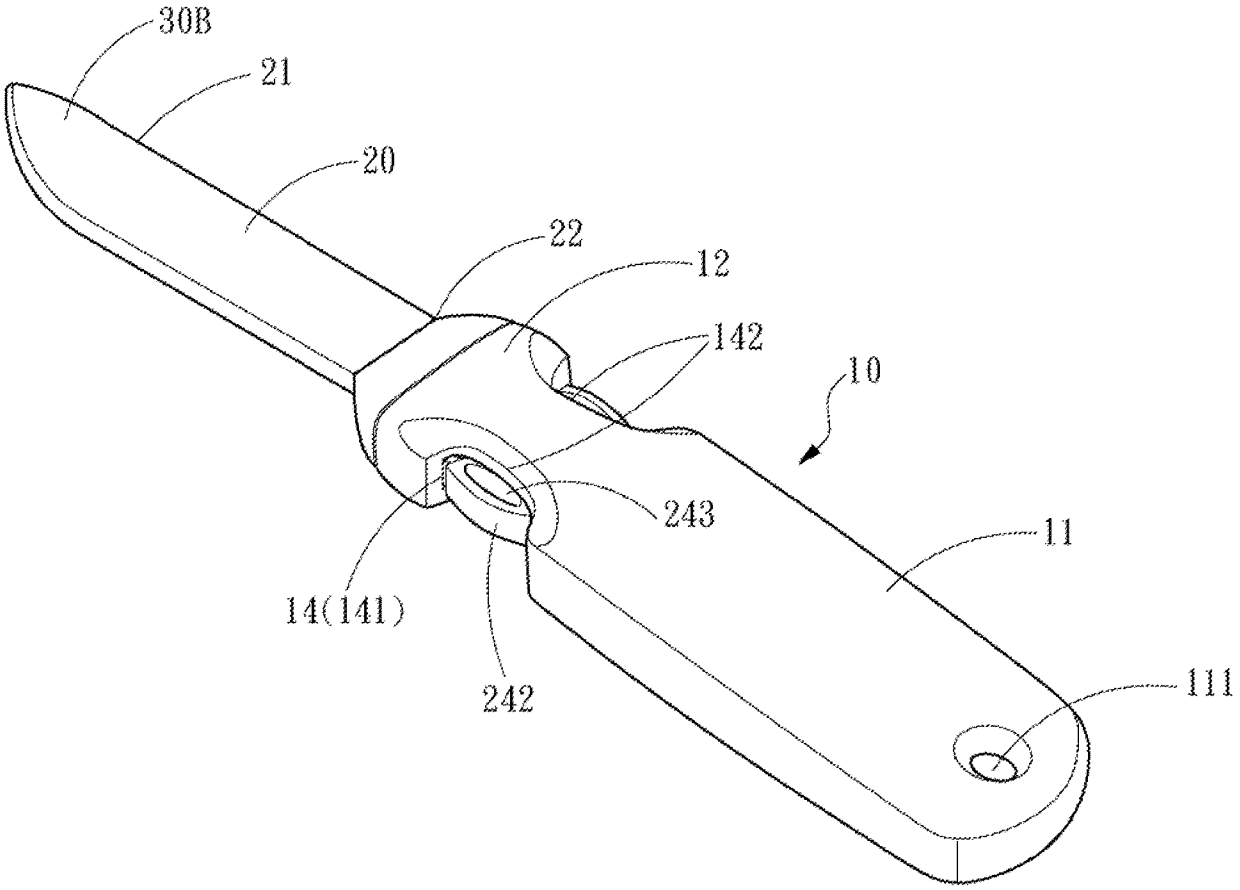
FIG. 5 is a perspective view schematically showing a disassembly tool kit for vehicular decorative plates or strips according to yet another embodiment of the present invention.
Figure 6:
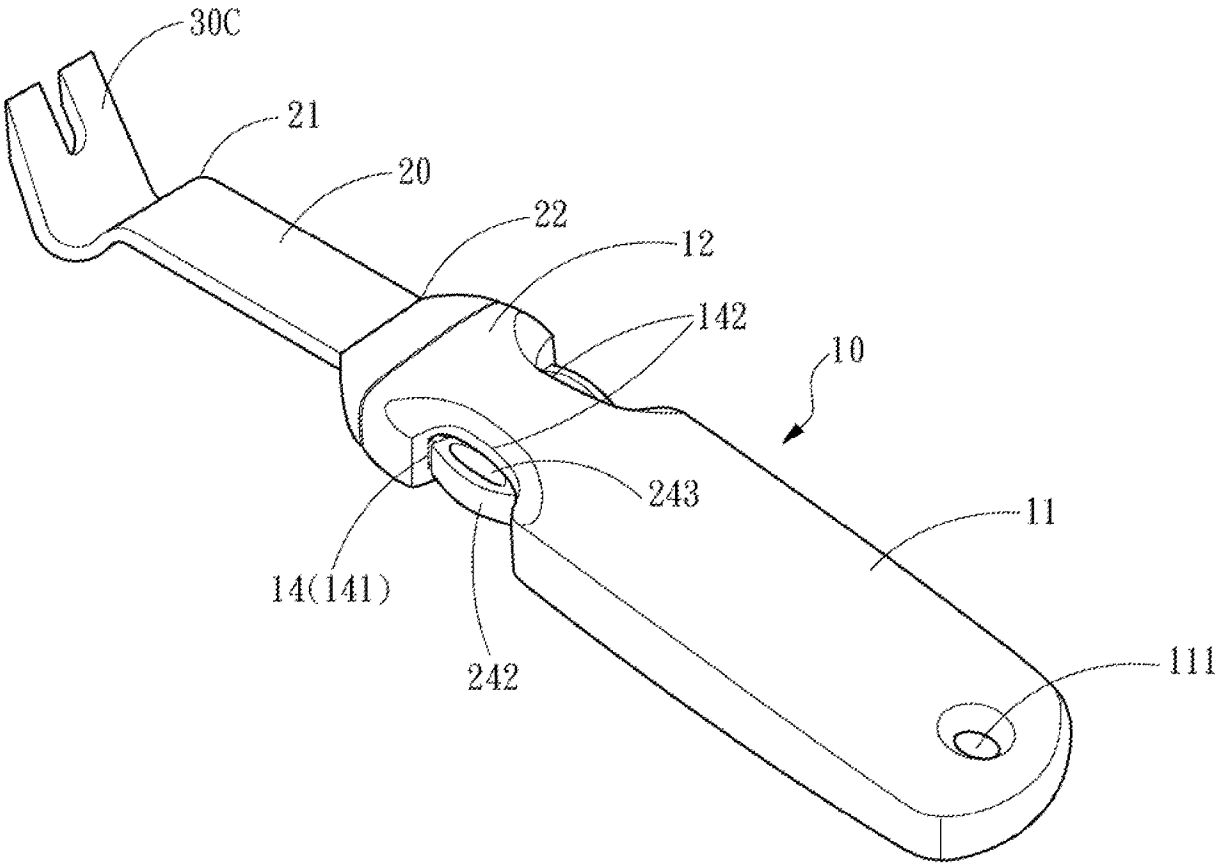
FIG. 6 is a perspective view schematically showing a disassembly tool kit for vehicular decorative plates or strips according to a further embodiment of the present invention.

Refer to FIGS. 4-6. The manufacturer may provide the user with the replaceable tools 20 respectively having different types of decorative-plate disassembly elements 30, such as the decorative-plate disassembly elements 30A, 30B and 30C, to let the user select a required one from them. Then, the user installs the corresponding replaceable tool 20 in the handle 10 to complete replacement and undertake operation.

Via the positioning hole of the first fixing element and the positioning pillar of the second fixing element, the replaceable tool is securely assembled to the handle without shaking. Via the first locking element and the second locking element, the replaceable tool is firmly locked to the handle without detachment. The user may select a desired decorative-plate disassembly element and assemble the corresponding replaceable tool to the handle to satisfy requirement in usage.

What is claimed is:

1. A disassembly tool kit for replacing vehicular decorative plates, comprising a handle including a handheld end and a handle-side engagement end far away from the handheld end, wherein the handle-side engagement end includes a first fixing element and a first locking element; and at least one replaceable tool each including a tool-side engagement end corresponding to the handle-side engagement end and a working end far away from the tool-side engagement end, wherein the working end includes a decorative-plate disassembly element, and wherein the tool-side engagement end includes a second fixing element corresponding to the first fixing element and a second locking element corresponding to the first locking element, and the second fixing element is firmly engaged with the first fixing element;

wherein the first fixing element is a positioning hole, the second fixing element is a positioning pillar; and a recess is formed in an inner area of the positioning pillar;

wherein the first locking element includes two press-fit slots each including an arc notch respectively formed on each side of the handle-side engagement end;

wherein the second locking element includes two elastic press-fit bars corresponding to the elastic press-fit slots, the two elastic press-fit bars are respectively disposed a corresponding side of the tool-side engagement end, and each of the two press-fit bars include an elliptic fastener protruding from a corresponding arc notch of the first locking element; and wherein each of the elliptic fasteners includes a central opening to increase a flexibility of the fasteners.

2. The disassembly tool kit for replacing vehicular decorative plates according to claim 1, wherein a through-hole is formed in the handheld end.

3. The disassembly tool kit for replacing vehicular decorative plates according to claim 1, wherein edges of the handheld end are chamfered into round corners.

* * * * *